US012473729B2

(12) United States Patent
Shinohara et al.

(10) Patent No.: US 12,473,729 B2
(45) Date of Patent: Nov. 18, 2025

(54) FLUSH TOILET APPARATUS

(71) Applicant: TOTO LTD., Kitakyushu (JP)

(72) Inventors: Yuuki Shinohara, Kitakyushu (JP); Hiroshi Hashimoto, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 118 days.

(21) Appl. No.: 18/396,264

(22) Filed: Dec. 26, 2023

(65) Prior Publication Data

US 2024/0287780 A1 Aug. 29, 2024

(30) Foreign Application Priority Data

Feb. 28, 2023 (JP) ..... 2023-030034

(51) Int. Cl.
*E03D 11/13* (2006.01)
*E03D 9/08* (2006.01)

(52) U.S. Cl.
CPC ..... *E03D 11/13* (2013.01); *E03D 9/08* (2013.01)

(58) Field of Classification Search
CPC ..... E03D 11/13; E03D 9/08; E03D 11/02; E03D 11/06
USPC ..... 4/420.4, 420.5
See application file for complete search history.

(56) References Cited

U.S. PATENT DOCUMENTS 4,242,764 A * 1/1981 Fukuda ..... E03D 9/08 4/233
4,327,451 A * 5/1982 Baus ..... E03D 9/08 4/420.4
5,987,659 A * 11/1999 Cannizzaro ..... E03D 9/085 4/420.4
6,105,179 A * 8/2000 Burns ..... E03D 9/08 4/420.4
8,108,953 B2 * 2/2012 Zeng ..... A47K 10/48 4/420.4
8,161,580 B2 * 4/2012 Hashidume ..... E03D 9/08 4/444
8,701,222 B2 * 4/2014 Shin ..... E03D 9/08 4/443
9,850,646 B2 12/2017 Mizoguchi et al.
2005/0028263 A1 * 2/2005 Wodeslavsky ..... E03D 9/085 4/420.4
2007/0204395 A1 * 9/2007 Scalzi ..... E03D 9/052 4/420.4

(Continued)

FOREIGN PATENT DOCUMENTS

CN 207959409 U 10/2018
DE 202010003453 U1 8/2010

(Continued)

*Primary Examiner* — Lori L Baker
(74) *Attorney, Agent, or Firm* — BakerHostetler

(57) ABSTRACT

A flush toilet apparatus includes a toilet main body and a warm water wash toilet seat, the toilet main body includes a bowl, a toilet upper surface, and a discharge trap conduit, and the warm water wash toilet seat includes a body part, a wash nozzle, and a toilet seat rotatably mounted to the body part and disposed on the toilet upper surface, to surround the bowl. On opposite ends of the toilet upper surface in a left-right direction, raised parts project upward, respectively, and the body part of the warm water wash toilet seat is configured to protrude downward from an upper end of each of the raised parts of the toilet main body.

9 Claims, 6 Drawing Sheets

(56) References Cited

U.S. PATENT DOCUMENTS

| | | | | |
|---|---|---|---|---|
| 2008/0092283 | A1* | 4/2008 | Cruz | E03D 9/085 4/420.4 |
| 2011/0016624 | A1* | 1/2011 | Zeng | A47K 10/48 4/420.2 |
| 2011/0072570 | A1* | 3/2011 | Morotomi | E03D 9/08 4/420.4 |
| 2018/0216328 | A1 | 8/2018 | Tanimoto et al. | |
| 2018/0216332 | A1 | 8/2018 | Ogawa et al. | |

FOREIGN PATENT DOCUMENTS

| | | | |
|---|---|---|---|
| JP | 50049937 | U | 5/1975 |
| JP | 58120287 | A | 8/1983 |
| JP | S59-130595 | U | 9/1984 |
| JP | 2006-009364 | A | 1/2006 |
| JP | 2015007313 | A | 1/2015 |
| JP | 2018-123667 | A | 8/2018 |
| JP | 2018123621 | A | 8/2018 |
| JP | 2018123632 | A | 8/2018 |
| JP | 2021-107628 | A | 7/2021 |

* cited by examiner

FLUSH TOILET APPARATUS

CROSS-REFERENCE TO RELATED APPLICATION

This application claims priority to foreign Japanese patent application No. JP 2023-030034, filed on Feb. 28, 2023, the disclosure of which is incorporated by reference in its entirety.

FIELD OF THE INVENTION

The present invention relates to a flush toilet apparatus, in particular to a flush toilet apparatus including a toilet main body and a warm water wash toilet seat placed on the toilet main body.

DESCRIPTION OF THE RELATED ART

In Japanese Patent Laid-Open No. 2018-123667 (Patent Literature 1), a mounting device for a wall-mounted toilet and a toilet system are described. In this toilet system, a toilet main body is supported on a wall surface by the mounting device for the wall-mounted toilet embedded in the wall surface, and a toilet seat unit with a warm water washing function is placed on the toilet main body. In such a wall-mounted toilet, a water supply pipe that supplies warm water to the toilet seat unit and a power supply cord that supplies power are drawn out from the wall surface, and after connecting the water supply pipe and power supply cord to the toilet seat unit, the toilet seat unit is placed on the toilet main body.

In a state where the water supply pipe and power supply cord are connected to the toilet seat unit, there is a problem that working efficiency in a work of placing the toilet seat unit (warm water wash toilet seat) in position on the toilet main body drops. In particular, if the toilet seat unit is not placed at an appropriate position on the toilet main body, the water supply pipe and power supply cord may get caught between the toilet main body and the toilet seat unit, thereby damaging them.

Accordingly, an object of the present invention is to provide a flush toilet apparatus including a warm water wash toilet seat that can be easily placed at an appropriate position on a toilet main body.

SUMMARY OF THE INVENTION

In order to solve the above-described problems, the present invention provides a flush toilet apparatus comprising a toilet main body and a warm water wash toilet seat placed on the toilet main body. The toilet main body comprises a bowl that receives waste, a toilet upper surface continuous with an upper end of the bowl and formed to surround the bowl, and a discharge trap conduit communicating with a bottom portion of the bowl. The warm water wash toilet seat comprises a body part, a wash nozzle provided so as to advance or retreat from the body part for jetting wash water, and a toilet seat rotatably mounted to the body part and disposed on the toilet upper surface, to surround the bowl. Raised parts projecting upward are provided at opposite ends of the toilet upper surface in a left-right direction, respectively, and the body part of the warm water wash toilet seat protrudes below an upper end of each of the raised parts of the toilet main body.

According to the present invention including this configuration, the raised parts are provided at the opposite ends of the toilet upper surface of the toilet main body in the left-right direction, respectively, so that a worker can easily recognize a proper position where the warm water wash toilet seat should be placed, when placing the warm water wash toilet seat on the toilet main body. This can improve working efficiency in a work of placing the warm water wash toilet seat on the toilet main body.

In the present invention, preferably, the raised parts are configured to be higher rearward of the toilet main body than forward of the toilet main body.

According to the present invention including this configuration, since the raised part is configured to be higher rearward of the toilet main body than forward of the toilet main body, the body part provided rearward of the warm water wash toilet seat can be positioned more accurately, and the working efficiency in the work of placing the warm water wash toilet seat can further improve.

In the present invention, preferably, the raised parts are linearly heightened from forward to rearward of the toilet main body.

According to the present invention including this configuration, since the raised parts are linearly heightened from forward to rearward of the toilet main body, the worker who grasps a front part of the warm water wash toilet seat is unlikely to manually interfere with the raised part when placing the warm water wash toilet seat, and the working efficiency in the work of placing the warm water wash toilet seat can further improve.

In the present invention, preferably, the raised part is not provided in a front end part of the toilet main body.

According to the present invention including this configuration, since the raised part is not provided in the front end part of the toilet main body, the warm water wash toilet seat is unlikely to interfere with the raised parts when the warm water wash toilet seat is placed at the proper position from forward of the toilet main body, and the working efficiency in the work of placing the warm water wash toilet seat can further improve.

In the present invention, preferably, each of the raised parts has a flat surface formed on an upper end of the raised part.

According to the present invention including this configuration, since the flat surface is formed on the upper end of each of the raised parts, the protruding raised parts can be prevented from being damaged during manufacturing, transporting or the like of the toilet main body.

In the present invention, preferably, the flat surface of the raised part is inclined lower inward of the toilet main body.

According to the present invention including this configuration, since the flat surface of the raised part is inclined lower inward of the toilet main body, the work of placing the warm water wash toilet seat on the toilet main body is also guided by the flat surface, and the working efficiency in the work of placing the warm water wash toilet seat can further improve.

In the present invention, preferably, the raised part includes an inner sloped surface formed to connect the flat surface and the toilet upper surface.

According to the present invention including this configuration, since the inner sloped surface connecting the flat surface and the toilet upper surface is formed in each of the raised parts, the work of placing the warm water wash toilet seat on the toilet main body is also guided by the inner sloped surface, and the working efficiency in the work of placing the warm water wash toilet seat can further improve.

In the present invention, preferably, the inner sloped surface of the raised part is concavely curved with a first curvature radius.

According to the present invention including this configuration, since the inner sloped surface of the raised part is concavely curved with the first curvature radius, the work of placing the warm water wash toilet seat on the toilet main body is smoothly guided by the inner sloped surface, and the work efficiency in the work of placing the warm water wash toilet seat can improve.

In the present invention, preferably, the inner sloped surface and the flat surface of the raised part are connected by a surface having a second curvature radius, and the first curvature radius is twice or more as large as the second curvature radius.

According to the present invention including this configuration, since the raised part is configured to have the first curvature radius of the inner sloped surface that is twice or more as large as the second curvature radius of the surface connecting the inner sloped surface and the flat surface, the work of placing the warm water wash toilet seat on the toilet main body can be guided more smoothly, and the working efficiency in the work of placing the warm water wash toilet seat can improve.

In the present invention, preferably, the first curvature radius is smaller rearward of the toilet main body than forward of the toilet main body.

According to the present invention including this configuration, since the raised part is configured to have the first curvature radius of the inner sloped surface that is smaller rearward of the toilet main body than forward of the toilet main body, a rear part of the warm water wash toilet seat is more strictly guided in the work of placing the warm water wash toilet seat, and the body part of the rear part of the warm water wash toilet seat can be more accurately positioned.

According to the flush toilet apparatus of the present invention, the warm water wash toilet seat can be easily placed at an appropriate position on the toilet main body.

DETAILED DESCRIPTION OF THE PREFERRED EMBODIMENT

Figure 1:
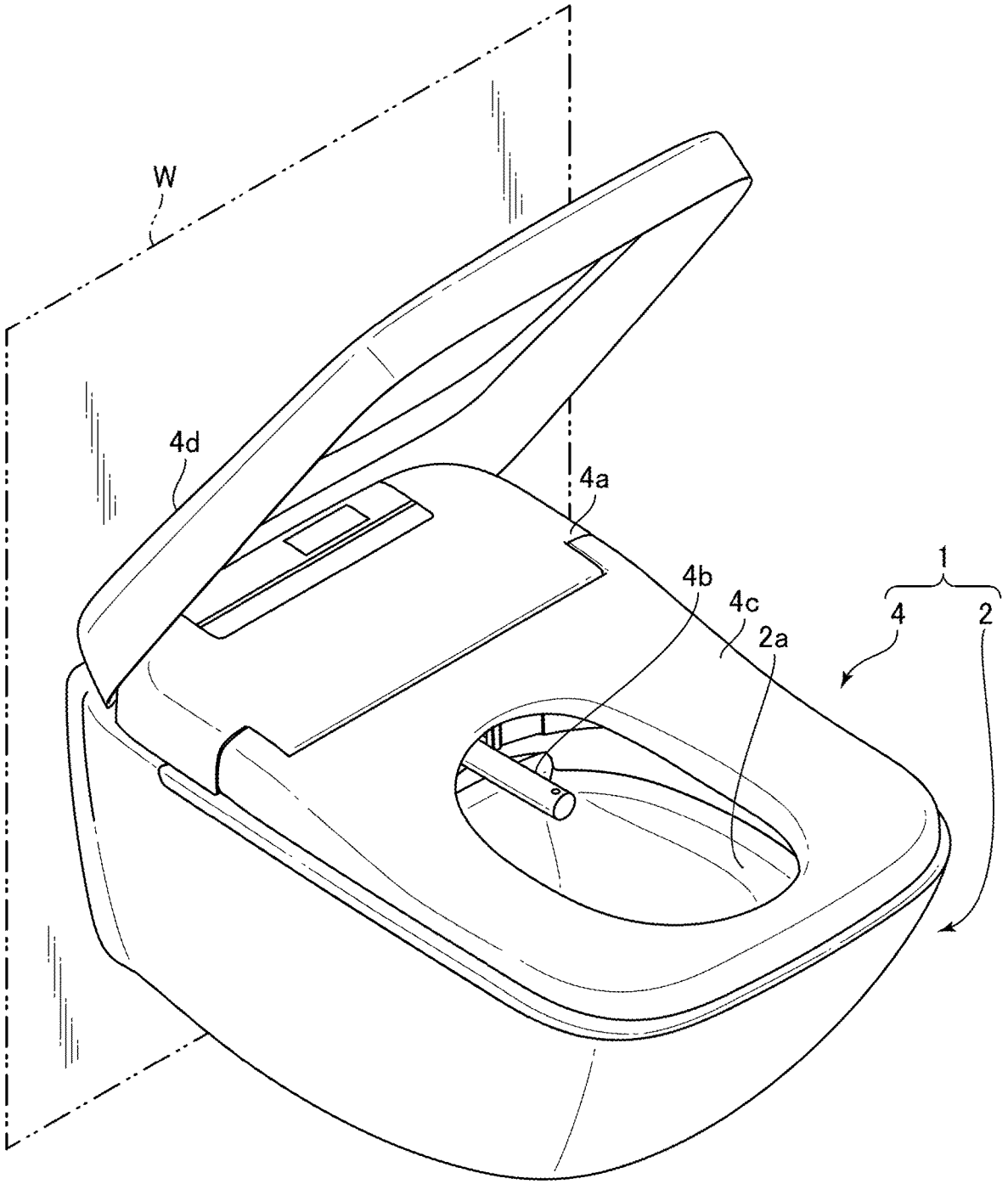
FIG. 1 is a perspective view showing an entire flush toilet apparatus of an embodiment of the present invention.
Figure 2:
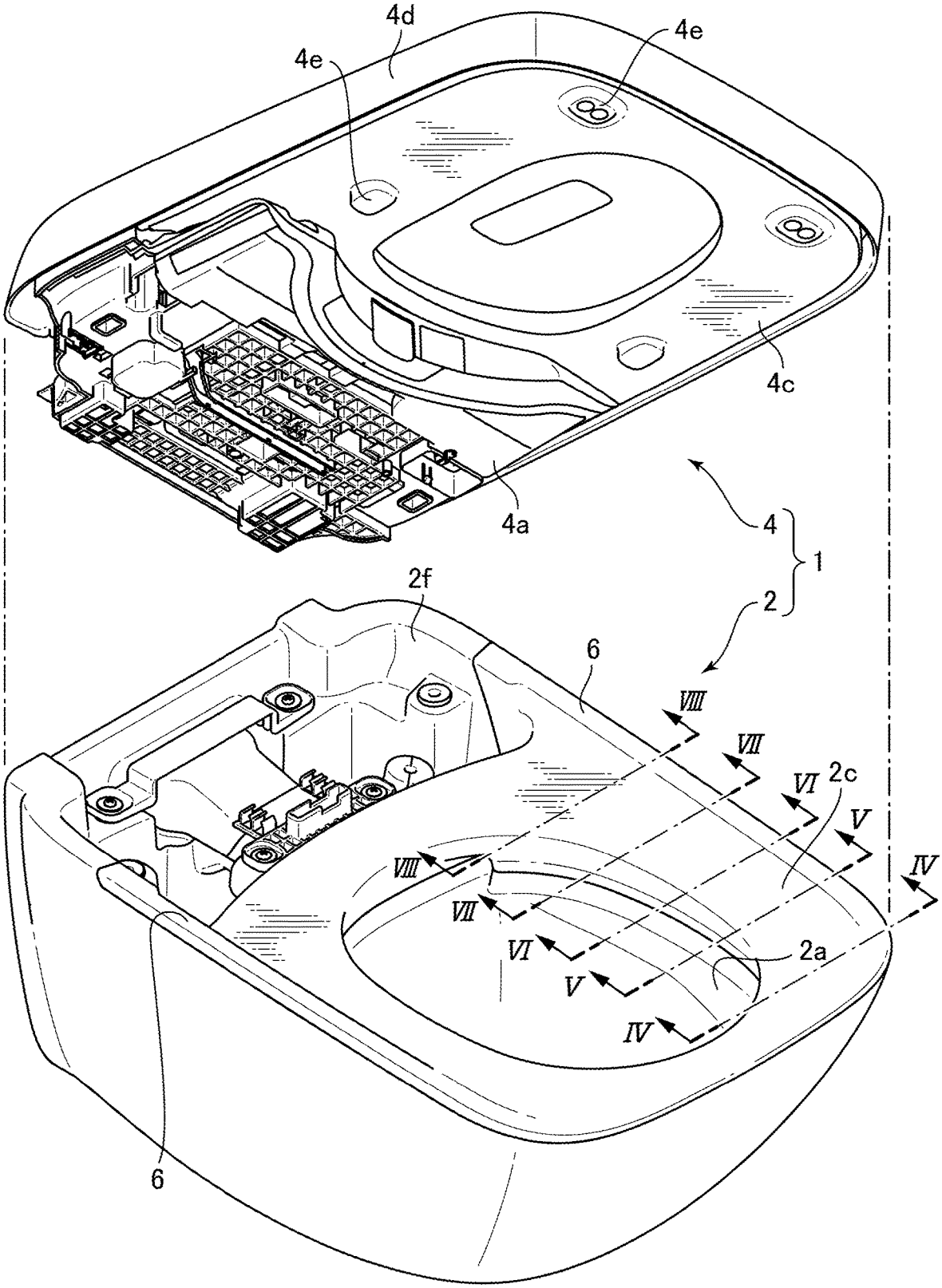
FIG. 2 is a perspective view showing a state where the flush toilet apparatus of the embodiment of the present invention is exploded into a toilet main body and a warm water wash toilet seat.
Figure 3:
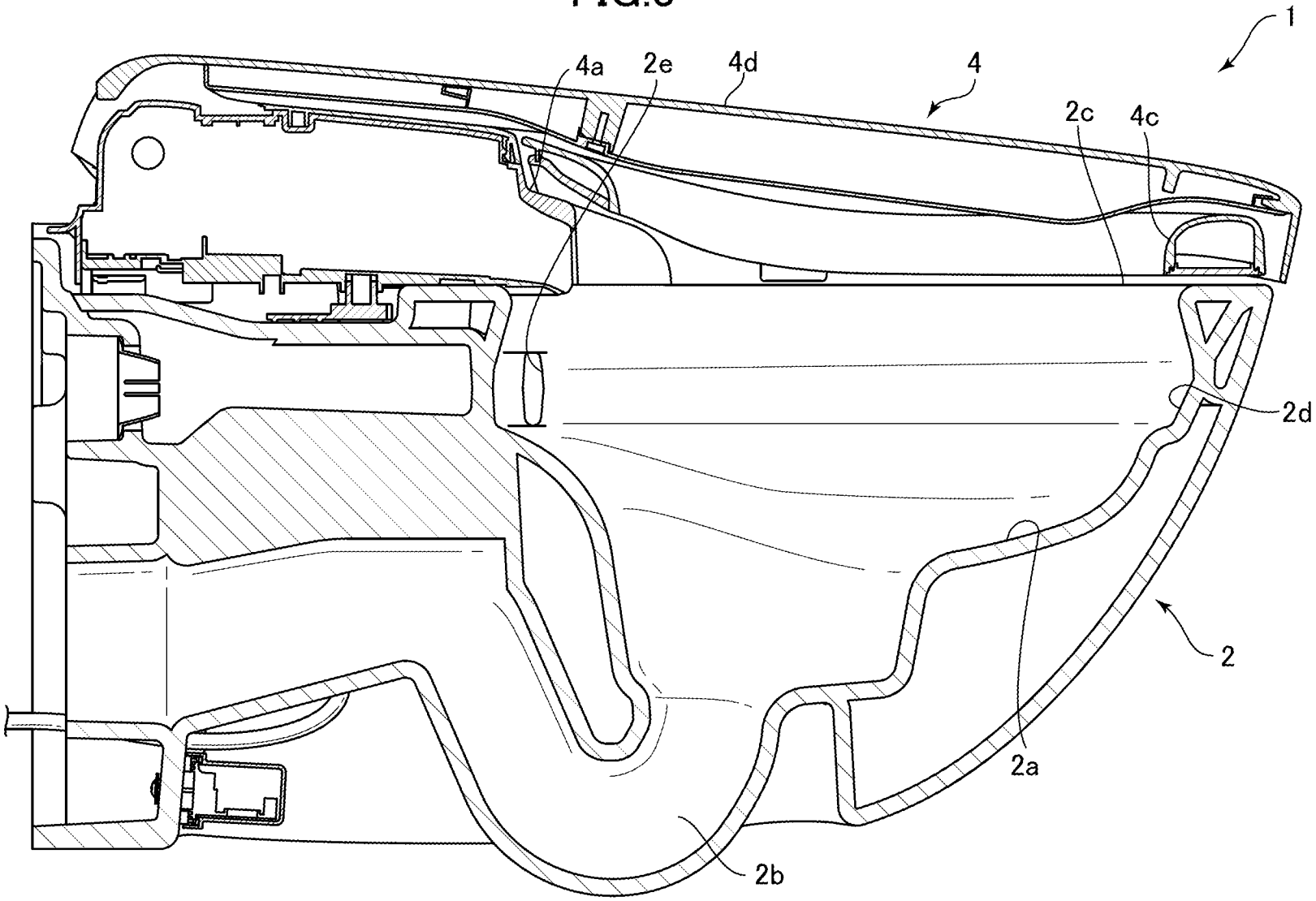
FIG. 3 is an entire cross-sectional view of the flush toilet apparatus of the embodiment of the present invention.

Next, with reference to the accompanying drawings, a flush toilet apparatus according to an embodiment of the present invention will be described. FIG. 1 is a perspective view showing the entire flush toilet apparatus of the embodiment of the present invention and shows a state where a toilet seat cover of a warm water wash toilet seat is opened. FIG. 2 is a perspective view showing a state where the flush toilet apparatus of the embodiment of the present invention is exploded into a toilet main body and a warm water wash toilet seat. FIG. 3 is an entire cross-sectional view of the flush toilet apparatus of the embodiment of the present invention.

As shown in FIG. 1, a flush toilet apparatus 1 of the embodiment of the present invention includes a toilet main body 2 and a warm water wash toilet seat 4 placed on the toilet main body 2. The flush toilet apparatus 1 of the present embodiment is a wall-mounted flush toilet mounted to a wall surface W, for use, and includes a reservoir tank (not shown) that supplies flush water to the toilet main body 2 and a discharge pipe (not shown) for discharging waste and flush water which are embedded in a back of the wall surface W. In the present embodiment, the toilet main body 2 is made of ceramic. Note that herein a side of the toilet main body 2 close to the wall surface W is referred to as rearward of the toilet main body 2, and an opposite side is referred to as forward of the toilet main body 2. Further, a direction parallel to the wall surface W is referred to as a left-right direction of the toilet main body 2.

As shown in FIGS. 2 and 3, the toilet main body 2 includes a bowl 2*a* that receives waste and a discharge trap conduit 2*b* communicating with a bottom portion of the bowl 2*a*. On an upper surface of the toilet main body 2, a toilet upper surface 2*c* is formed to surround the bowl 2*a*. The toilet upper surface 2*c* is connected to an edge of an upper end of the bowl 2*a* and extends generally horizontally. As shown in FIG. 3, a rim 2*d* is formed in an upper end part of the bowl 2*a*, and a rim spout port 2*e* is formed to spout flush water along the rim 2*d*. When flushing the toilet, an inner wall surface of the bowl 2*a* is flushed with flush water spouted from the rim spout port 2*e*, and waste within the bowl 2*a* and reserved water reserved in the bottom portion of the bowl 2*a* are discharged through the discharge trap conduit 2*b*.

As shown in FIG. 1, the warm water wash toilet seat 4 includes a body part 4*a*, a wash nozzle 4*b* provided so as to advance or retreat from the body part 4*a*, a toilet seat 4*c* rotatably mounted to the body part 4*a*, and a toilet seat cover 4*d* rotatably mounted to the body part 4*a*, to cover the toilet seat 4*c*.

The body part 4*a* is placed rearward of the upper surface of the toilet main body 2 and stores the wash nozzle 4*b*, a drive mechanism (not shown) of the wash nozzle 4*b*, a water supply system (not shown) of wash water to the wash nozzle 4*b*, and others inside. As shown in FIG. 2, an opening 2*f* is formed on the upper surface of the toilet main body 2, and a bottom portion of the body part 4*a* protrudes into the opening 2*f*. In the present embodiment, a water supply pipe (not shown) being drawn out from the wall surface W and supplying warm water to the warm water wash toilet seat 4 and a power supply code (not shown) supplying power to the warm water wash toilet seat 4 are connected from inside the toilet main body 2 through the opening 2*f* to the body part 4*a*.

The wash nozzle 4*b* (FIG. 1) is mounted to the body part 4*a* so as to advance or retreat in a front-rear direction of the toilet main body 2. When in use, the wash nozzle 4*b* advances forward and diagonally downward from the body part 4*a* and jets wash water from a jet port (not shown) provided at a tip end. Thereby, a user of the flush toilet apparatus 1 has a private part washed.

As shown in FIG. 1, the toilet seat 4*c* is rotatably mounted to the body part 4*a* and is disposed on the toilet upper surface 2*c* so as to surround the bowl 2*a* for the user of the flush toilet apparatus 1 to sit down. In a state where the toilet seat 4*c* is disposed on the toilet upper surface 2*c*, the upper surface of the toilet main body 2 is covered with the body part 4*a* and the toilet seat 4*c*. Further, four legs 4*e* (FIG. 2) are provided on a bottom surface of the toilet seat 4*c*, and the legs 4*e* abut on the toilet upper surface 2*c* of the toilet main body 2 to support the toilet seat 4*c* above the toilet main body 2.

The toilet seat cover 4*d* is rotatably mounted to a rear part of the body part 4*a*. In a closed state of the toilet seat cover 4*d*, the body part 4*a* and toilet seat 4*c* of the warm water wash toilet seat 4 are covered with the toilet seat cover 4*d*.

Figure 4:
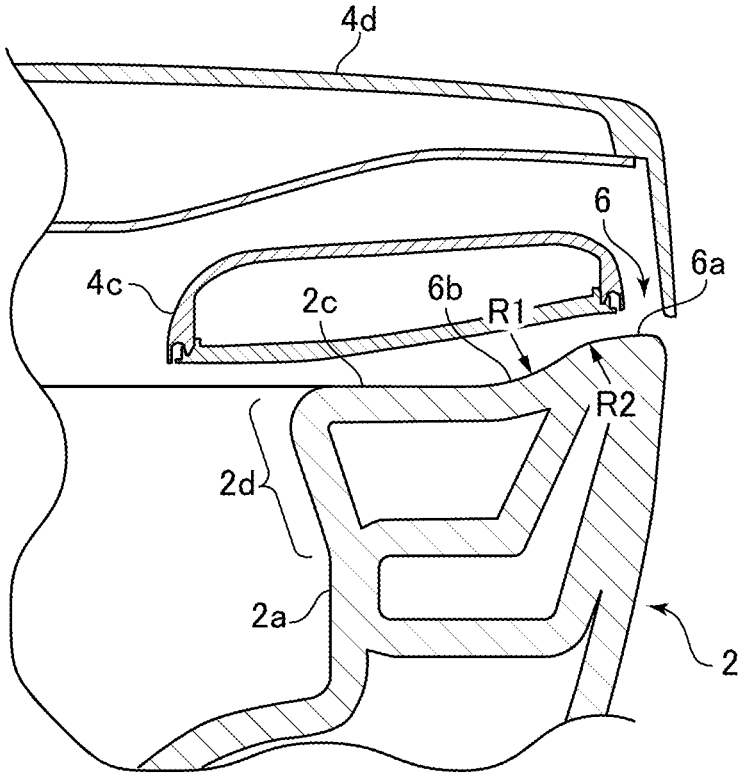
FIG. 4 is a partially enlarged cross-sectional view of the flush toilet apparatus of the embodiment of the present invention taken along the IV-IV line of FIG. 2.

Next, with reference to FIGS. 2 and 4 to 8, a configuration of a raised part provided on the toilet upper surface 2*c* of the toilet main body 2 will be described. FIGS. 4 to 8 are enlarged views showing the raised part in cross sections of the flush toilet apparatus of the present embodiment taken along the IV-IV line to VIII-VIII line of FIG. 2. Here, FIG. 4 is a cross-sectional view of the flush toilet apparatus 1 taken along the vicinity of a front end part of the bowl 2*a*, and hereinafter FIGS. 5 to 8 show in order cross sections taken along positions closer to a rear part of the bowl 2*a*.

As shown in FIG. 2, raised parts 6 projected upward are provided at opposite ends in the left-right direction, respectively, on the toilet upper surface 2*c* of the toilet main body 2. Since the raised parts 6 are provided at the opposite ends of the toilet upper surface 2*c* in the left-right direction, the opposite ends of the toilet upper surface 2*c* are raised and heightened. The raised parts 6 allow a worker to recognize, visually and by feel of fingers, an accurate position where the warm water wash toilet seat 4 should be placed when placing the warm water wash toilet seat 4 on the toilet upper surface 2*c* of the toilet main body 2 and improve working efficiency. Further, a part of the body part 4*a* of the warm water wash toilet seat 4 is configured to protrude downward from an upper end of each of the raised parts 6 provided on the toilet upper surface 2*c* in a state where the body part is placed on the toilet main body 2.

Here, the toilet upper surface 2*c* of the toilet main body 2 is generally flat and horizontally oriented, while the raised part 6 is heightened rearward of the toilet main body 2. For this reason, the upper end of the raised part 6 is inclined higher rearward of the toilet main body 2 relative to a horizontal plane, and the raised part 6 is linearly heightened from forward to rearward of the toilet main body 2. Then, in the vicinity of the front end part of the toilet main body 2, the raised part 6 has a height close to zero, and the raised part 6 is not provided in the front end part of the toilet main body 2 (an area of a forward edge of the toilet upper surface 2*c*). Thus, since the raised part 6 is not provided in the front end part of the toilet main body 2, the raised part 6 does not hinder a work of placing the warm water wash toilet seat 4 from forward of the toilet main body 2 to the toilet upper surface 2*c* and can improve the working efficiency.

Figure 5:
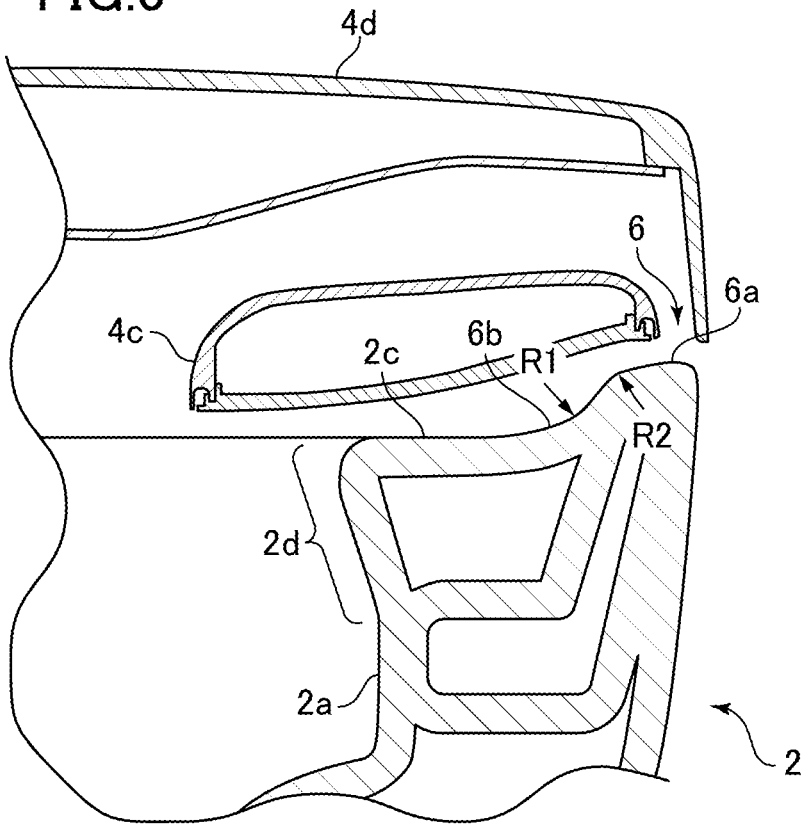
FIG. 5 is a partially enlarged cross-sectional view of the flush toilet apparatus of the embodiment of the present invention taken along the V-V line of FIG. 2.
Figure 6:
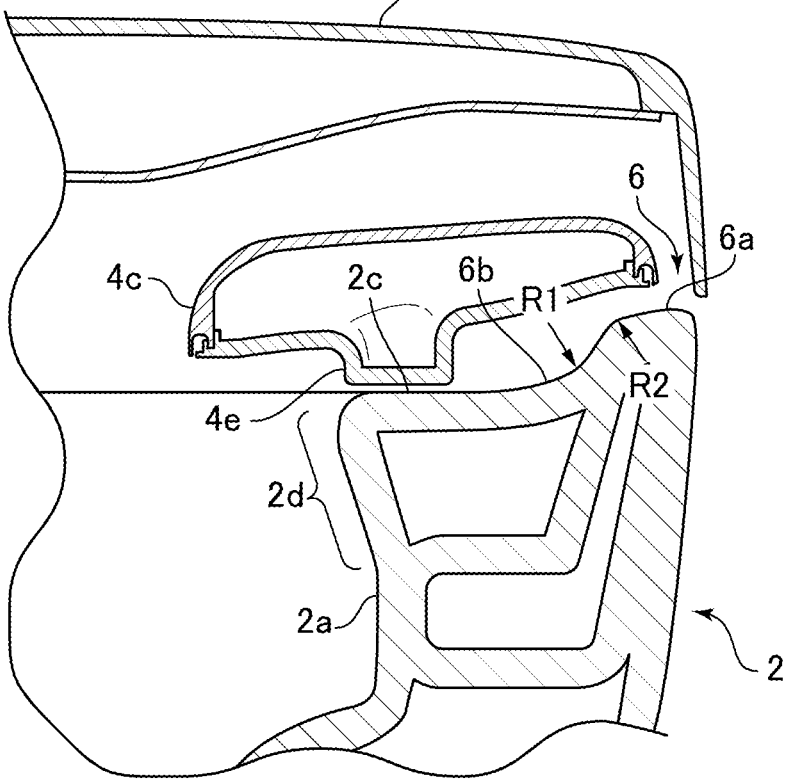
FIG. 6 is a partially enlarged cross-sectional view of the flush toilet apparatus of the embodiment of the present invention taken along the VI-VI line of FIG. 2.
Figure 7:
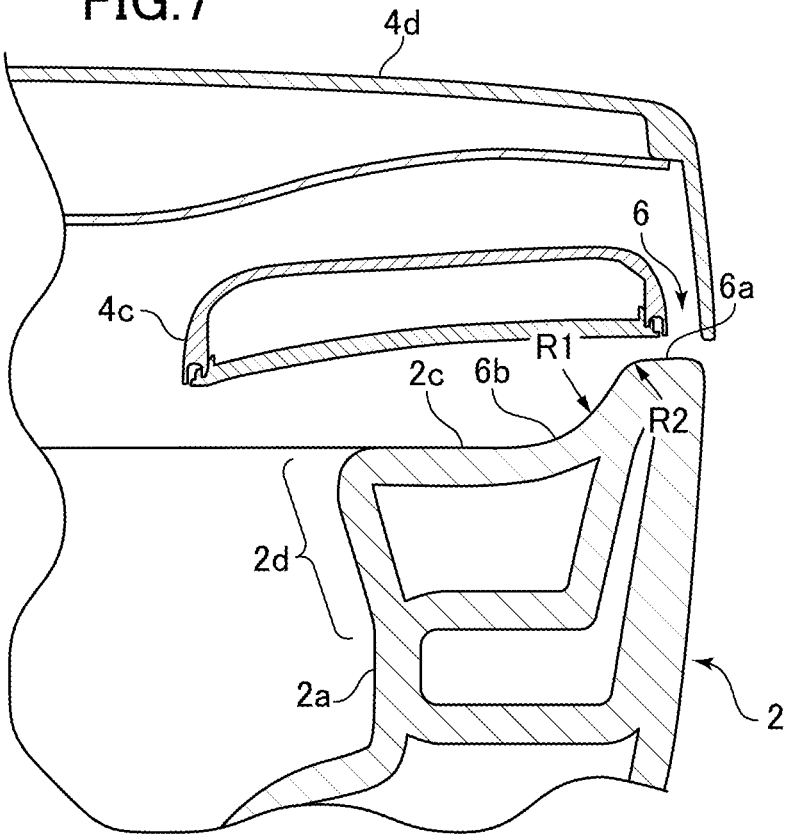
FIG. 7 is a partially enlarged cross-sectional view of the flush toilet apparatus of the embodiment of the present invention taken along the VII-VII line of FIG. 2.
Figure 8:
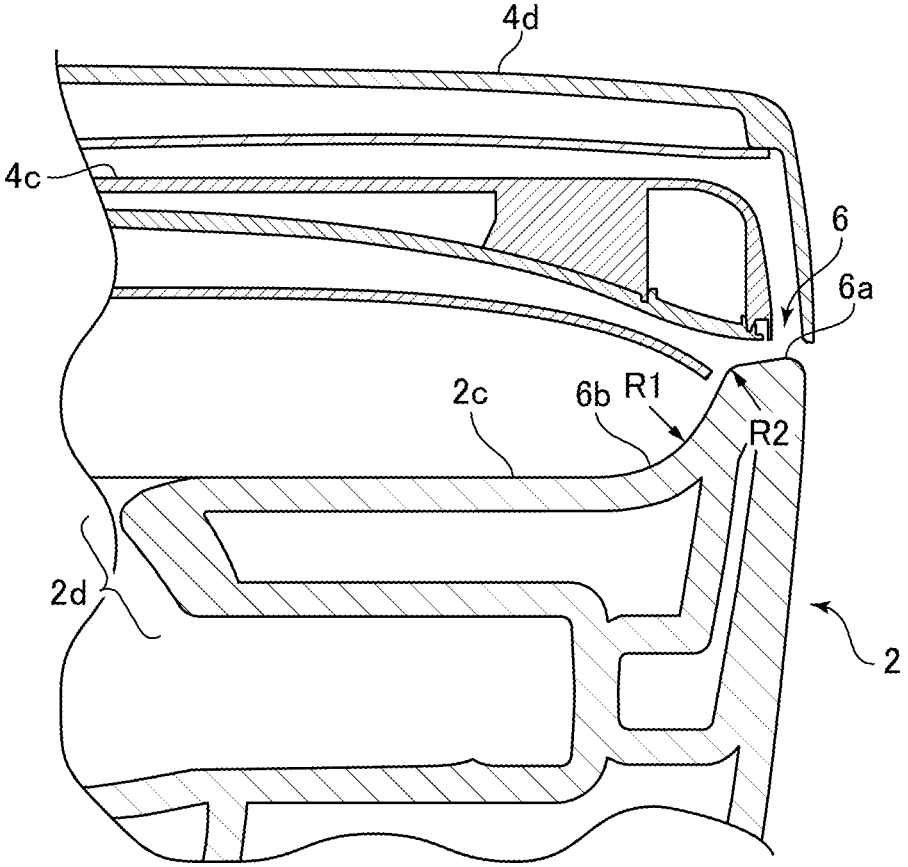
FIG. 8 is a partially enlarged cross-sectional view of the flush toilet apparatus of the embodiment of the present invention taken along the VIII-VIII line of FIG. 2.

As shown in FIGS. 4 to 8, the toilet seat 4*c* is placed so as to cover at least a portion of the raised part 6 from above. The legs 4*e* (FIG. 6) provided on the bottom surface of the toilet seat 4*c* form a predetermined gap between the toilet upper surface 2*c* of the toilet main body 2 and the bottom surface of the toilet seat 4*c*. As shown in FIGS. 4 to 6, the toilet seat 4*c* is configured to have a thickness in an outer peripheral edge being smaller than a thickness in an inner peripheral edge, so that the raised part 6 projected from the toilet upper surface 2*c* does not to interfere with the bottom surface of the toilet seat 4*c*.

As shown in FIGS. 4 to 8, a flat surface 6*a* is formed generally evenly on the upper end of the raised part 6. Thus, the flat surface 6*a* provided on the upper end of the raised part 6 can prevent the raised part 6 from being damaged during transport or the like of the toilet main body 2.

Further, the flat surface 6*a* is inclined lower inward of the toilet main body 2 in the cross-sectional view of the toilet main body 2 in the left-right direction. Thus, the flat surface 6*a* inclined lower inward allows the worker to recognize the position where the warm water wash toilet seat 4 should be placed, by the feel of fingers, when placing the warm water wash toilet seat 4 on the toilet upper surface 2*c*, so that the warm water wash toilet seat 4 can be easily placed at a proper position. The toilet upper surface 2*c* of the toilet main body 2 is smoothly connected to the flat surface 6*a* of the raised part 6 by an inner sloped surface 6*b*.

The inner sloped surface 6*b* is concavely curved with a first curvature radius R1 in the cross-sectional view of the toilet main body 2 in the left-right direction. The evenly flat surface 6*a* is also smoothly connected to the concavely curved inner sloped surface 6*b*, and a portion (surface) connecting the flat surface 6*a* and the inner sloped surface 6*b* is rounded with a second curvature radius R2 in the cross-sectional view of the toilet main body 2 in the left-right direction.

Here, the first curvature radius R1 the concavely curved inner sloped surface 6*b* has is reduced gradually from FIG. 4 to FIG. 8. That is, the inner sloped surface is configured in such a way that the first curvature radius R1 is reduced gradually from forward to rearward of the toilet main body 2. Thus, reducing the first curvature radius R1 of the inner sloped surface 6*b* rearward of the toilet main body makes clearer the position, in the left-right direction, where the body part 4*a* of the warm water wash toilet seat 4 should be placed, making it easier to place the warm water wash toilet seat 4 in the proper position. In the present embodiment, the inner sloped surface 6*b* is configured in such a way that the first curvature radius R1 of the inner sloped surface is twice or more as large as the second curvature radius R2 of the portion connecting the inner sloped surface 6*b* and the flat surface 6*a*.

According to the flush toilet apparatus 1 of the embodiment of the present invention, the raised parts 6 are provided at the opposite ends of the toilet upper surface 2*c* of the toilet main body 2 in the left-right direction, respectively (FIG. 2), so that the worker can easily recognize a proper position where the warm water wash toilet seat 4 should be placed, when placing the warm water wash toilet seat 4 on the toilet main body 2. This can improve the working efficiency in the work of placing the warm water wash toilet seat 4 on the toilet main body 2.

According to the flush toilet apparatus 1 of the present embodiment, since the raised part 6 is configured to be higher rearward of the toilet main body 2 than forward of the toilet main body (FIG. 2), the body part 4*a* provided rearward of the warm water wash toilet seat 4 can be positioned more accurately, and the working efficiency in the work of placing the warm water wash toilet seat 4 can further improve.

According to the flush toilet apparatus 1 of the present embodiment, since the raised parts 6 are linearly heightened from forward to rearward (FIG. 2), the worker who grasps a front part of the warm water wash toilet seat 4 is unlikely to manually interfere with the raised parts 6 when placing the warm water wash toilet seat 4, and the working efficiency in the work of placing the warm water wash toilet seat 4 can further improve.

According to the flush toilet apparatus 1 of the present embodiment, since the raised part is not provided in the front end part of the toilet main body 2 (FIG. 2), the warm water wash toilet seat 4 is unlikely to interfere with the raised parts 6 when the warm water wash toilet seat 4 is placed at the proper position from forward of the toilet main body 2, and the working efficiency in the work of placing the warm water wash toilet seat 4 can further improve.

According to the flush toilet apparatus 1 of the present embodiment, since the flat surface 6*a* is formed on the upper end of each of the raised parts 6 (FIGS. 4 to 8), the protruding raised parts 6 can be prevented from being damaged during manufacturing, transporting or the like of the toilet main body 2.

According to the flush toilet apparatus 1 of the present embodiment, since the flat surface 6*a* of the raised part 6 is inclined lower inward of the toilet main body 2 (FIGS. 4 to 8), the work of placing the warm water wash toilet seat 4 on the toilet main body 2 is also guided by the flat surface 6*a*, and the working efficiency in the work of placing the warm water wash toilet seat 4 can further improve.

According to the flush toilet apparatus 1 of the present embodiment, since the inner sloped surface 6*b* connecting the flat surface 6*a* and the toilet upper surface 2*c* is formed in the raised part 6 (FIGS. 4 to 8), the work of placing the warm water wash toilet seat 4 on the toilet main body 2 is also guided by the inner sloped surface 6*b*, and the working efficiency in the work of placing the warm water wash toilet seat 4 can further improve.

According to the flush toilet apparatus 1 of the present embodiment, since the inner sloped surface 6*b* of the raised part 6 is concavely curved with the first curvature radius R1 (FIGS. 4 to 8), the work of placing the warm water wash toilet seat 4 on the toilet main body 2 is smoothly guided by the inner sloped surface 6*b*, and the work efficiency in the work of placing the warm water wash toilet seat 4 can improve.

According to the flush toilet apparatus 1 of the present embodiment, since the raised part 6 is configured to have the first curvature radius R1 of the inner sloped surface 6*b* that is twice or more as large as the second curvature radius R2 of the surface connecting the inner sloped surface 6*b* and the flat surface 6*a*, the work of placing the warm water wash toilet seat 4 on the toilet main body 2 can be guided more smoothly, and the working efficiency in the work of placing the warm water wash toilet seat 4 can improve.

According to the flush toilet apparatus 1 of the present embodiment, since the raised part is configured to have the first curvature radius R1 of the inner sloped surface 6*b* that is smaller rearward of the toilet main body 2 than forward of the toilet main body, a rear part of the warm water wash toilet seat 4 is more strictly guided in the work of placing the warm water wash toilet seat 4, and the body part 4*a* of the rear part of the warm water wash toilet seat 4 can be more accurately positioned.

As above, although the flush toilet apparatus 1 of the embodiment of the present invention has been described, various changes can be made to the above-described embodiment. In particular, in the above-described embodiment, the present invention is applied to the wall-mounted flush toilet apparatus 1, but the present invention can be applied also to a floor-mounted flush toilet apparatus. In the above-described embodiment, the water supply pipe and power supply cord extending from the wall surface W where the flush toilet apparatus 1 is installed are connected through an interior of the toilet main body 2 to the body part 4*a* of the warm water wash toilet seat 4. However, the present invention can be applied also to a flush toilet apparatus where a water supply pipe and/or power supply cord extending from a wall surface or floor surface is connected through an exterior of a toilet main body to a warm water wash toilet seat.

REFERENCE SIGNS LIST

1 flush toilet apparatus
2 toilet main body
2*a* bowl
2*b* discharge trap conduit
2*c* toilet upper surface
2*d* rim
2*e* rim spout port
2*f* opening
4 warm water wash toilet seat
4*a* body part
4*b* wash nozzle
4*c* toilet seat
4*d* toilet seat cover
4*e* leg
6 raised part
6*a* flat surface
6*b* inner sloped surface

What is claimed is:

1. A flush toilet apparatus comprising a toilet main body, and a warm water wash toilet seat placed on the toilet main body, the toilet main body comprising:

a bowl that receives waste, a toilet upper surface continuous with an upper end of the bowl and formed to surround the bowl, and a discharge trap conduit communicating with a bottom portion of the bowl, the warm water wash toilet seat comprising:

a body part, a wash nozzle provided so as to advance or retreat from the body part for jetting wash water, and a toilet seat rotatably mounted to the body part and disposed on the toilet upper surface, to surround the bowl, wherein raised parts projecting upward are provided at opposite ends of the toilet upper surface in a left-right direction, respectively, wherein only a portion of the body part of the warm water wash toilet seat protrudes downward below an upper end of each of the raised parts of the toilet main body, and wherein the raised parts are linearly heightened from forward to rearward of the toilet main body.

2. The flush toilet apparatus according to claim 1, wherein the raised parts are configured to be higher rearward of the toilet main body than forward of the toilet main body.

3. The flush toilet apparatus according to claim 1, wherein a height of the raised part is zero in a front end part of the toilet main body.

4. The flush toilet apparatus according to claim 1, wherein each of the raised parts has a flat surface formed on an upper end of the raised part.

5. The flush toilet apparatus according to claim 4, wherein the flat surface of the raised part is inclined lower inward of the toilet main body.

6. The flush toilet apparatus according to claim 4, wherein the raised part includes an inner sloped surface formed to connect the flat surface and the toilet upper surface.

7. The flush toilet apparatus according to claim 6, wherein the inner sloped surface of the raised part is concavely curved with a first curvature radius.

8. The flush toilet apparatus according to claim 7, wherein the inner sloped surface and the flat surface of the raised part are connected with a surface having a second curvature radius, and the first curvature radius is twice or more as large as the second curvature radius.

9. The flush toilet apparatus according to claim 7, wherein the first curvature radius is smaller rearward of the toilet main body than forward of the toilet main body.

* * * * *